United States Patent [19]

Decker et al.

[11] 4,346,129

[45] Aug. 24, 1982

[54] METHOD AND APPARATUS FOR THICKNESS CONTROL OF A COATING

[75] Inventors: Charles E. Decker, Canton; John L. Hostetler, North Canton, both of Ohio

[73] Assignee: Republic Steel Corporation, Cleveland, Ohio

[21] Appl. No.: 239,697

[22] Filed: Mar. 2, 1981

[51] Int. Cl.[3] ..... B05C 3/12; B05D 3/04

[52] U.S. Cl. ..... 427/348; 118/63; 118/67; 118/419; 427/349; 427/398.1; 427/434.5

[58] Field of Search ..... 118/63, 67, 419, 421; 427/348, 349, 434.5, 398.1

[56] References Cited

U.S. PATENT DOCUMENTS

| | | | |
|---|---|---|---|
| 287,076 | 10/1883 | Young . | |
| 3,320,086 | 5/1967 | Rose et al. . | |
| 3,375,805 | 4/1968 | Beall et al. . | |
| 3,406,656 | 10/1968 | Patterson . | |
| 3,494,324 | 2/1970 | Bauer et al. . | |
| 3,499,418 | 3/1970 | Mayhew . | |
| 3,607,366 | 9/1971 | Kurokawa . | |
| 3,670,695 | 6/1972 | Patterson . | |
| 3,722,462 | 3/1973 | Pohler et al. . | |
| 3,756,844 | 9/1973 | Bunnell et al. . | |
| 3,808,033 | 4/1974 | Mayhew . | |
| 4,041,895 | 8/1977 | Overton et al. . | |
| 4,128,668 | 12/1978 | Ernest | 118/63 X |
| 4,171,392 | 10/1979 | Sievert et al. | 427/349 X |

*Primary Examiner*—Michael R. Lusignan
*Attorney, Agent, or Firm*—Watts, Hoffmann, Fisher & Heinke Co.

[57] ABSTRACT

An improved air knife apparatus and method for controlling coating thickness on a moving metal strip. Air flow from blowers is supplied through a plenum chamber common to an air knife and a diffuser spaced along the path of strip travel. A valve between the plenum chamber and diffuser controls the relative flow of air through the knife and diffuser to establish the desired pressure and flow at the air knife to modify the thickness of the coating on the strip. The flow through the diffuser is directed against the strip at a location subsequent to the knife in the direction of strip travel, to chill the coating.

13 Claims, 3 Drawing Figures

METHOD AND APPARATUS FOR THICKNESS CONTROL OF A COATING

BACKGROUND OF THE INVENTION

1. Field of the Invention

This invention relates to a system and method for controlling the thickness of a coating applied to a moving substrate, more particularly for controlling the thickness and distribution of a zinc coating applied to a steel substrate in a "hot dip" galvanizing process.

2. Prior Art

In a "hot dip" galvanizing process, a moving substrate such as steel is coated with a material such as molten zinc by feeding the substrate through a coating bath. The substrate emerges from the bath along a generally vertical feed path with molten coating material deposited on its surfaces. The coating process must be controlled to assure a substantially uniform coating thickness on the resulting product. Such control avoids wasteful deposition of excessively thick coatings, and assures that the coated substrate will perform in a predictable and desired manner in such handling processes as coiling, stacking, and shipment, and in such fabricating processes as die forming and welding. Coating thickness depends on factors that include the speed at which the substrate proceeds through the coating line, which is typically variable. A relatively high substrate velocity is usually maintained during most of a coating run, but will be reduced from time to time to permit the attachment of a new source of substrate to a source nearing depletion.

While the basic thickness of a desired coating can be modified by the line speed, coating thickness and distribution also can be modified after a coated substrate has emerged from the coating bath. Control system have included such devices as rolls that wring the coated substrate to the proper coating thickness, and fluid devices, which do not engage the substrate, but rather control substrate coating thickness by directing controlled streams of pressurized fluid toward the coated substrate. There is a trend in the galvanizing industry to convert to coating control methods and systems that utilize some form of a fluid knife to avoid mechanical problems associated with wringers. The advantages of such knives over coating rolls have been clearly demonstrated, and more recently the advantages of air over steam as a knife fluid has also been shown. Generally, the air systems use high volume, low pressure air for reasons related to efficiency, noise and simplicity. The state of the art now permits air knives to control a great range of coating thicknesses over a broad range of line speeds on large variations of strip width and gauge.

Air requirements for the knives vary both with the substrate line speed and the width of the substrate being coated, and with the coating thickness desired. By way of example, under various operating conditions, opposing air knives may require as much as 8000 cubic feet per minute (CFM) or as little as 200 CFM or less. A blower capable of supplying the maximum quantity of air can be reduced in speed, but not below its slowest stable point of operation. Even at that point the blower output may be many times more than that desired for the particular knife application.

Past solutions to this problem have included simple venting to the atmosphere or bleeding off of unwanted air volume. Those solutions are inefficient, and such methods have tended to be erratic and unpredictable with complex controlling apparatus. Moreover, the same conditions that require very low quantities of air from the coating knife, namely thick coatings on narrow stock, have typically required a slower line speed than otherwise desired, because the thicker zinc coating freezes slowly and must be given adequate time to solidify before reaching conveying rollers outside the bath. Thus, the slow speed coating operation presents a two-fold problem of difficult blower control complicated by a long coating solidification period.

SUMMARY OF THE INVENTION

The present invention overcomes both of the above problems, i.e., the unstable blower operation at low speed and the slow freezing of thick coatings, by providing, along with fluid knives, a diffusing fluid outlet on each side of the coated strip or substrate, spaced downstream from the knives along the path of strip travel. Fluid in excess of that needed by the knives for coating control is supplied and the excess is directed from the diffusing outlets against the substrate surfaces after the strip or substrate has passed the knives, to cool or solidify the coating. For a given source pressure, the proportion of fluid applied as a diffused flow can be varied to establish the necessary fluid pressure and fluid flow from the knives, to effect the desired coating thickness.

In the preferred arrangement, a knife plenum for each knife is supplied with air under pressure from a blower. A diffuser plenum is connected by an air passage to the knife plenum and has diffusing outlets closely adjacent to the path of the strip or substrate. A valve in the air passage permits proportioning of flow between the knife plenum and the diffuser plenum to establish a desired ratio of fluid flow between the knife and the diffusing outlets. The flow and pressure supplied to the knives on opposite sides of the coated substrate strip are substantially equal. A damper in the diffuser plenum is selectively opened or closed, as needed, to allow all flow to go to the air knives or to reduce the pressure and flow to the air knives in the proportion established by the valve.

A particular valve position will maintain approximately the same proportion between pressures and flows in the knife and diffuser plenums over a variety of air flows that result from modulation of the blower speed with changes in substrate speed, which modulation is typically under automatic control. Basic coating control is thereby automatically maintained. By this invention, then, air knife flow and pressure are controlled to achieve desired coating thickness results through a large range of substrate variables with the blower operating at efficient speeds; and in addition, excess blower air is utilized to improve the process by enhancing the cooling or solidification of the coating to assure that the coating is stabilized for physical handling before reaching conveying rollers, thereby permitting faster strip travel speeds.

The above and other advantages and features of the invention will become more apparent from the following detailed description of the preferred embodiment of the invention when read with reference to the accompanying drawings.

PREFERRED EMBODIMENT OF THE INVENTION

Figure 1:
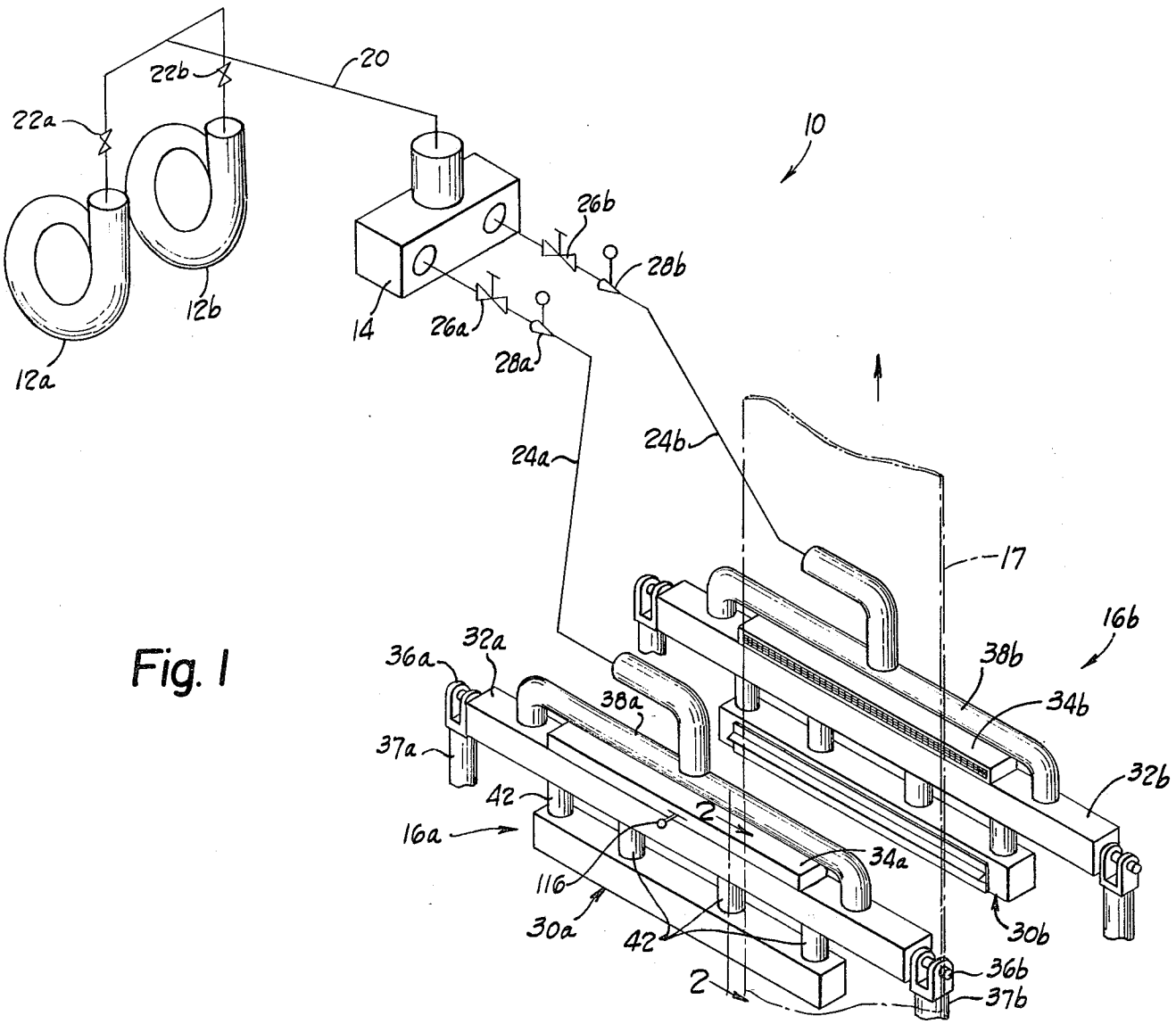
FIG. 1 is a diagrammatic isometric view of a coating thickness control apparatus embodying the invention, showing a pair of air knife apparatus and a coated substrate drawn vertically between the pair.
Figure 3:
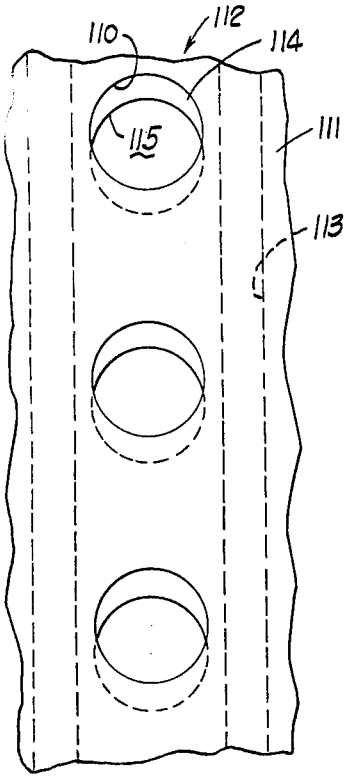
FIG. 3 is a partial top view of a sliding valve taken along the line 3—3 of FIG. 2.

Referring to the drawings, there is shown in FIG. 1 a coating thickness control apparatus 10 that includes sources 12*a*, 12*b* of a pressurized fluid, a distributor 14 for the pressurized fluid, and a pair of air knife apparatus 16*a*, 16*b* for treating both sides of a coated strip or substrate 17 that travels vertically between the knife apparatus 16*a*, 16*b* after emerging from a coating line (not shown).

Pressurized fluid is generated by operation of sources 12*a*, 12*b*. Typically the fluid will be a compressible gas, such as air, steam or the like, and the sources 12*a*, 12*b* will be compressors, blowers, steam generators, or the like. In this preferred embodiment the fluid is air and the sources 12*a*, 12*b* are blowers of variable capacity, the capacity being controlled in any suitable or conventional manner in response to variations in travel speed of the substrate 17 through the coating line.

Pressurized fluid moves from the sources 12*a*, 12*b* through a conduit 20. Valves 22*a*, 22*b* in the conduit 20 function to isolate the sources 12*a*, 12*b* for servicing. Pressurized fluid from the conduit 20 passes through the distributor 14, and exists through separate conduits 24*a*, 24*b* which are connected to manifolds 38*a*, 38*b*, respectively, to conduct the pressurized fluid to the pair of air knife apparatus 16*a*, 16*b*. Valves 26*a*, 26*b* function to control the pressure and flow of the fluid to each air knife apparatus 16*a*, 16*b*. They are manipulated in response to readings from pressure sensing devices 28*a*, 28*b*.

The knife apparatus 16*a*, 16*b* are mirror image structures. Therefore the structure and operation of one such knife apparatus will be described fully, it being understood that the other apparatus is constructed and operates similarly. The air knife apparatus 16*a* comprises knife assembly 30*a*, a collecting plenum chamber 32*a* supplied by the manifold 38*a*, and a diffuser 34*a*. The apparatus 16*a* is adjustably supported on journals 36*a*, 36*b* by rods 37*a*, 37*b*.

Figure 2:
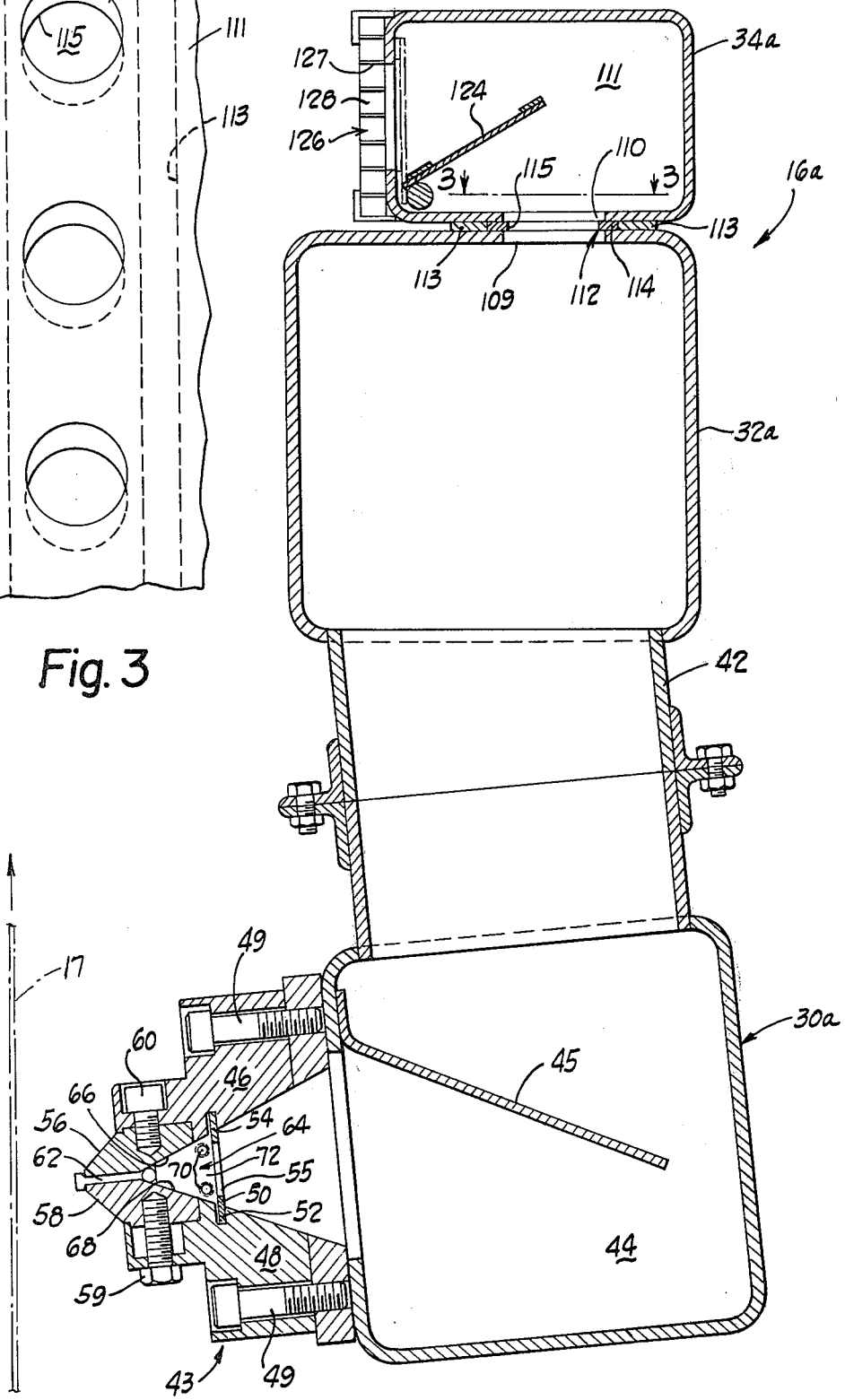
FIG. 2 is a cross sectional view of an air knife apparatus embodying the invention, taken along the line 2—2 of FIG. 1.

FIG. 2 shows a cross section of the knife apparatus 16*a*. Connectors 42 are arranged in fluid communicating relationship between the collecting plenum 32*a* and the knife assembly 30*a*. As illustrated, the knife assembly 30*a* comprises an air knife 43 of any suitable or conventional construction, and a knife plenum chamber 44, that includes a baffle 45. In this preferred embodiment, the air knife 43 includes an upper knife lip support 46 and a lower knife lip support 48 attached by cap screws 49 to the knife plenum 44. A shutter plate 50 is received in slots 52, 54 on the lip supports and defines a central opening 55 through which the flow of air passes. The opening 55 may vary in dimension along the length of the air knife, with wider openings tending to produce thinner coatings on the substrate.

Knife lips 56, 58, through which air from the knife is discharged, are attached to the knife lip supports 46, 48 in spaced relationship, by fasteners 59, 60. Adjustable seals 62 at opposite ends of the lips 56, 58 inhibit air flow between the lips of the air knife apparatus 16*a* beyond the width of the coated substrate 17. The seals themselves are a separate invention of J. L. Bedwell.

A vane assembly 64 is positioned between converging surfaces 66, 68 of the lips 56, 58. The vane assembly 64 includes a pair of mounting rods 70 that support vanes 72. The vanes 72 serve to align air flows passing between the vanes and then through the opening 55 prior to focusing of the air flow by the lips 56, 58 for impingement on the substrate.

In operation, pressurized air enters the collecting plenum 32*a* via the conduit 24*a* and flows through the connector 42 into the knife plenum 44. After flowing around the baffle 45 the air moves through the opening 55, between the vanes 72, and is focused between the lips 56, 58 for impingement against the substrate. Rotation of the knife assembly 16*a* on the support journals 36*a*, 36*b* permits adjustment of the angle of impingement of the air flow against the substrate.

The volume and pressure of the air impinging against the substrate substantially determines the thickness and contour of the deposited substrate coating. Through variations in the width of the opening 55, contours may be established in the coating. Generally, for a given substrate width, lower air flows are used to shape thicker coatings.

When changes occur in the operational speed of the substrate 17 through the coating line, generally the air flow through the knife assembly 16*a* must be correspondingly altered so that coating thickness will not be affected. This alteration to air flow is accomplished in the preferred embodiment by reducing the operational capacity of the blowers 12*a*, 12*b* through adjustments in operating speed. Reductions in blower capacity are practical only to the minimum point of stable blower operation, and simple blower speed reduction to the point of minimum stable operation will not produce satisfactory coating thickness control in some modes of coating line operation requiring air flows substantially below the blower maximum capacity. Where blower turndown cannot accommodate a low air flow requirement at the knife assembly 30*a*, some further control over air flow is necessary.

To accommodate low air flow requirements the diffuser 34*a* is in air flow communication with an opening 109 in the collecting plenum 32*a*. It diffuses and releases air, in excess of that required for thickness control, against the moving substrate at a location downstream from the knife 43 in the direction of substrate travel. The diffuser 34*a* includes a plenum chamber 111 having a plurality of openings 110. A valve 112 is arranged between the diffuser plenum 111 and the collecting plenum 32*a* joining these plenums in spaced relationship. The valve 112 includes guides 113 and a slide 114 having a plurality of openings 115. The valve guides 113 establish a spacing between plenums 32*a* and 111 in which the slide 114 is received. The openings 115 in the slide are aligned with the openings 110 in the diffuser plenum by movement of the slide 114 within the guide 113. A handle 116 (FIG. 1) is used to move the slide. Partial or complete alignment of the openings 110, 115 permits air to flow from the collecting plenum 32*a* into the diffuser plenum 111. The greater the extent of alignment between openings 110, 115, the greater the flow of air into the diffuser plenum 111 for any given air pressure output from the blowers 12*a*, 12*b*.

The diffuser 34*a* also includes a hinged damper 124 and a diffusing register 126. The hinged damper 124, when closed, interrupts air flowing through the diffusing register 126 from the plenum 111. With the damper 124 in a near vertical position, air flow through the register is effectively precluded. The register 126 is of a suitable construction for diffusing air passing therethrough, and in the preferred embodiment includes a large number of small openings 127 through a flat plate 128 parallel to and, opposing the coated metal substrate 17. A portion of air available in the plenum 32*a* is diverted for application through the diffusing register 126 against the coated substrate when the valve 112 is positioned to align some portion of the openings 110, 115, and the damper 124 is opened. Application of the diffused air flow against the coated substrate affects the temperature of the substrate and coating, generally promoting more rapid solidification of the coating on the substrate, facilitating subsequent substrate handling operations. Application of such a diffused pattern of air flow to the substrate has no significant impact upon the coating shape or thickness established by the air knife assembly 30*a*.

Adjustment of the slide valve 112 to align greater or smaller portions of the openings 110, 115 effectively proportions the flow of air available under pressure in the plenum 32*a* into a portion impinged through the knife 43 against the substrate 17 to control substrate coating thickness and contour, and a portion diffused through the register 126 against the substrate 17 following coating thickness control. For a given flow of air available in the plenum 32*a*, changing the position of the valve 112 will vary the portion of the air flow available to the air knife 43; opening the valve 112 will decrease air available to the knife 43 while closing the valve 112 will increase air flow available to the knife. Inversely, closing the valve 112 decreases the portion of air flow available for diffusing against the substrate 17, which can affect the rate of solidification of the substrate coating.

A particular position of the valve 112 effectively defines proportions of an air flow available at the plenum 32*a* between the air knife 43 and the register 126. A particular advantage of this preferred embodiment is that, for a given valve position, a roughly similar proportion is maintained throughout air flow volume variations arising from modulations to blower 12*a*, 12*b* operating speeds that are triggered by variations in substrate throughput on the coating line. Thus, once a valve setting has been established for a coating run of a particular thickness on a particular substrate 17, proportions roughly equal to those defined by that valve setting are obtained throughout line speed and blower capacity variations, assuring generally uniform coating control throughout a run of that substrate.

While a preferred embodiment of the invention has been described in detail, it will be apparent that various modifications or alterations may be made therein without departing from the spirit and scope of the invention set forth in the appended claims.

We claim:

1. Apparatus for controlling the thickness of a coating applied to a moving strip comprising:

an air knife for impinging a flow of air against a moving coated strip, a plenum chamber communicating with the air knife for accumulating a supply of air under pressure;

a second plenum chamber with a discharge opening and means for diffusing a flow of air discharged through the opening, for applying a diffused flow of air against the moving strip, said second plenum chamber being located downstream from the air knife in a direction of strip travel;

means, including an air passage and a control valve, for communicating between the plenum chambers, said control valve being adjustable to establish a proportion of flow from the first plenum chamber to each of the air knife and second plenum chamber; and means including a blower for supplying a flow of air under pressure to the first plenum chamber.

2. Apparatus as set forth in claim 1 including a damper for selectively allowing or preventing flow from the second plenum chamber through the diffusing means, without operating the control valve.

3. In a method of controlling the thickness of a coating applied to a moving strip, the steps comprising:

directing a flow of fluid under pressure to the surface of a moving strip through an air knife extending across a width of the strip at a first location to modify the coating thickness;

applying a diffused flow of fluid to the same surface of the moving strip across the width of the strip at a second location subsequent to the first location in the direction of strip travel, to chill the coating;

supplying said two flows of fluid from a common fluid source; and controlling a proportion of the flow of the fluid from the common source that is applied as a diffused flow at the second location to establish a desired pressure and flow of fluid from the air knife for a given pressure and flow of fluid from the common source.

4. The method as set forth in claim 3 including the steps of changing the speed of strip movement, changing the pressure and flow of fluid from the common source proportionately to the change in strip speed while maintaining the same proportion of the common flow at the two locations.

5. A method for controlling the thickness of a coating applied to a moving strip, including the steps of:

proportioning a flow of gaseous fluid into two substantially continuous portions;

impinging the first portion against the moving strip at a relatively high velocity; and applying the second portion to the moving strip at a relatively low velocity at a location subsequent in a direction of strip travel to where the first portion is applied.

6. Apparatus for controlling the thickness of a coating applied to a moving strip including:

means for defining first and second portions of a gaseous fluid flow;

means including an air knife for impinging the first portion against the moving strip to control the thickness of the coating on the strip; and means including an opening for discharging the second portion against the strip at a location subsequent in the direction of strip travel to where the first portion is impinged to transfer heat between the fluid and coating.

7. A method of controlling the thickness of a coating applied to a moving strip, including the steps of:

proportioning a flow of gaseous fluid into two substantially continuous portions;

impinging the first portion against a moving strip at a relatively high velocity;

applying the second portion to the moving strip at a relatively low velocity and at a location subsequent in a direction of strip travel to where the first portion impinges; and varying the proportion in response to desired changes in finished coated strip physical characteristics.

8. The method of either claim 5 or 7, including the step of modulating the flow of air in response to variations in the rate of strip movement.

9. The method of either claim 5 or 7, including the step of diffusing the second portion prior to application to the moving strip.

10. The method of either claim 5 or 7, wherein the gaseous fluid is air.

11. An apparatus for controlling the thickness of a solidifiable galvanized coating, applied to a moving steel strip including:

a source of substantially continuous flow of gaseous fluid under pressure;

means including a first plenum chamber for accumulating a supply of the gaseous fluid;

proportioning means for defining first and second flows of the gaseous fluid;

means including an air knife and a second plenum chamber in gaseous fluid communication with the first plenum chamber for accumulating the first flow and for impinging the first flow upon the moving strip at a relatively high velocity; and means including an opening in gaseous fluid communication with the first plenum chamber for discharging the second flow against the moving strip at a location subsequent in a direction of strip motion to impingement by the first flow, and at a relatively low velocity.

12. An apparatus for controlling the thickness of a solidifiable fluid coating, such as galvanized coating, applied to a moving strip including:

a source of substantially continuous flow of gaseous fluid under pressure;

means including a first plenum chamber for accumulating a supply of the gaseous fluid;

means including a valve for variably defining a first and second portion of the gaseous fluid;

means including a second plenum chamber and an air knife in gaseous fluid communication with the first plenum chamber for accumulation a supply of the first portion and for impinging the first portion upon the moving strip at a relatively high velocity; and means including an opening in gaseous fluid communication with the first plenum chamber for discharging the second portion against the moving strip at a relatively low velocity and at a location subsequent in a direction of strip motion to where the first portion is impinged.

13. The apparatus of any of claims 6, 11, or 12 including a means for diffusing the second portion prior to application to the strip.

* * * * *